US008485915B2

(12) United States Patent
Evans

(10) Patent No.: US 8,485,915 B2
(45) Date of Patent: Jul. 16, 2013

(54) VARIABLE LENGTH GOLF CLUB SHAFT

(75) Inventor: D. Clayton Evans, San Marcos, CA (US)

(73) Assignee: Callaway Gold Company, Carlsbad, CA (US)

( * ) Notice: Subject to any disclaimer, the term of this patent is extended or adjusted under 35 U.S.C. 154(b) by 133 days.

(21) Appl. No.: 13/286,791

(22) Filed: Nov. 1, 2011

(65) Prior Publication Data

US 2013/0109488 A1 May 2, 2013

(51) Int. Cl.
*A63B 53/10* (2006.01)

(52) U.S. Cl.
USPC ..... 473/296; 473/309

(58) Field of Classification Search
USPC ..... 473/296
See application file for complete search history.

(56) References Cited

U.S. PATENT DOCUMENTS

| | | | | |
|---|---|---|---|---|
| 2004/0116197 | A1* | 6/2004 | Benson | 473/239 |
| 2009/0270197 | A1* | 10/2009 | Holtzman | 473/296 |
| 2010/0081515 | A1* | 4/2010 | White et al. | 473/296 |
| 2010/0304881 | A1* | 12/2010 | Chol | 473/296 |
| 2011/0081984 | A1* | 4/2011 | Beach et al. | 473/296 |

* cited by examiner

*Primary Examiner* — Michael Dennis
(74) *Attorney, Agent, or Firm* — Rebecca Hanovice; Michael A. Catania; Sonia Lari

(57) ABSTRACT

A variable length shaft assembly comprising a shaft adapter, a grip support, and an engagement device is disclosed herein. The variable length shaft assembly of the present invention allows a golfer to quickly, semi-permanently, and inexpensively change the overall length of the shaft assembly, such that the shaft performs as desired and conforms to USGA rules. The variable length shaft assembly of the invention may further a travel limiter to prevent parts of the shaft assembly from disengaging from each other. Methods of adjusting the length of a golf club shaft without damaging any portion of the shaft are also disclosed herein.

19 Claims, 8 Drawing Sheets

VARIABLE LENGTH GOLF CLUB SHAFT

CROSS REFERENCES TO RELATED APPLICATIONS

None

STATEMENT REGARDING FEDERALLY SPONSORED RESEARCH OR DEVELOPMENT

None

BACKGROUND OF THE INVENTION

1. Field of the Invention

The present invention relates to a variable length shaft assembly that allows for quick, semi-permanent length adjustments. More specifically, the present invention relates to a variable length shaft that conforms to USGA rules, and whose length can be adjusted without the use of shaft extension components.

2. Description of the Related Art

Customization of golf clubs to help golfers attain better shots has become a popular and more prevalent practice in recent years. Golf club manufacturers and designers have devised various features to allow club fitters and golf club players to adjust certain characteristics of their clubs. Such characteristics include loft, lie, face angle, center of gravity (CG) location, and club length.

Current technology provides two methods to adjust overall club length. One such method involves the destruction and removal of the grip on a shaft. Upon removal of the grip by peeling or tearing, the end portion of the shaft is trimmed to decrease the club length or an extension piece is affixed to the end of the shaft to increase its length. Aftermarket extensions are available specifically for this purpose; alternatively, extensions can be made from portions of other golf club shafts that are cut to the desired length and then inserted into the end of the first club's shaft. The extension piece must match the diameter of the existing shaft, so it is necessary at times to build up the diameter of the extension or existing shaft by adding layers of tape. This method requires that the user making the adjustments have access to potentially expensive new components and tools as well as having a high level of skill. It also causes damage to the original shaft and grip.

The second method of adjusting club length involves replacing the entire shaft and grip using a semi-permanent head-shaft connection device that some manufacturers offer with their clubs, particularly with drivers. The existing shaft may be removed from the driver head and replaced with a different shaft that has either a shorter or longer length. This method is not possible on all clubs, however, as the head must have hardware that allows for removal of the shaft and replacement with a new shaft without damaging the head.

A golfer who does not possess club altering skills or the necessary disposable income to purchase new components likely will be daunted by these two methods of adjusting club length. The first method requires the golfer to make use of several tools to remove the grip and cut the shaft if he or she desires a shorter length, and also to have materials such as tape and a replacement grip on hand to replace the grip and mend any damage caused to the shaft and grip. The skill set required to change the shaft length using this method is usually beyond the abilities of the average golfer, so the golfer would need to seek the services of a golf club fitter or technician to have their club length changed. The second method requires the golfer to buy an entirely new shaft at a different length, which can be very expensive, and also may require the golfer to retain a golf club fitter or technician to replace the shaft.

Ultimately, the two methods described above require an inventory of spare components and above average technical skill, particularly with regard to the first method. It is therefore desirable to facilitate the change of a club's length using a faster, easier, and less expensive system and method than is currently available.

BRIEF SUMMARY OF THE INVENTION

One aspect of the present invention is a variable length golf club shaft comprising a shaft, a shaft adapter, an engagement adapter, an engagement device, a screw, and a cylindrical grip support comprising an exterior surface and an interior surface, the interior surface comprising a plurality of notches, wherein the shaft adapter comprises a first end affixed to the shaft and a second end affixed to the engagement adapter, wherein the engagement device is affixed to the engagement adapter with the screw, wherein the shaft adapter is inserted into the grip support such that the engagement device fits within one or more of the plurality of notches, and wherein tightening the screw causes the engagement device to semi-permanently engage at least one of the plurality of notches. The engagement device may be a snap ring, a flange, or a wedge.

In some embodiments, at least a portion of the exterior surface of the grip support comprises a grip, and at least one of the plurality of notches extends around the circumference of the interior surface of the grip support. The grip support may further comprise an opening located at an upper-most end of the grip support sized to permit access to the screw when the variable length golf club shaft is fully assembled. The plurality of notches may comprise at least two notches, which may be spaced from each other by a distance of between 0.100 and 1.00 inch, such as approximately 0.125 inch. The variable length golf club shaft of the present invention may further comprise a travel limiter.

Another aspect of the present invention is a golf club comprising a golf club head, a shaft having a tip end and a butt end, the tip end connected to the golf club head, a shaft adapter comprising a first end affixed to the butt end of the shaft and a second end affixed to an engagement device, a cylindrical grip support disposed around the shaft adapter, the grip support comprising an interior surface comprising a plurality of notches and an exterior surface comprising a grip, and a screw, wherein the grip support has a diameter large enough to permit the grip adapter to slide along the length of the shaft adapter when the engagement device is not in a tightened configuration, and wherein tightening the screw causes the engagement device to semi-permanently engage one or more of the plurality of notches, and prevents the grip support from sliding along the length of the shaft adapter. The engagement device may be a snap ring, a flange, or a wedge, and the golf club head may be an iron head, a putter head, or a driver head.

In one embodiment, the golf club may further comprise a travel limiter. In some embodiments, each of the plurality of notches is spaced from neighboring notches by at least 0.100 and no more than 0.150 inch, and in yet another embodiment each of the plurality of notches is spaced from neighboring notches by approximately 0.125 inch. In some embodiments, the second end of the shaft adapter may have a non-circular cross-section. In yet another embodiment, the grip support may have a total range of movement of five inches.

Another aspect of the present invention is a method comprising providing a golf club shaft with a first end and a second end, providing a shaft adapter having a first end and a second end, affixing the first end of the shaft adapter to the second end of the shaft, affixing an engagement device to the second end of the shaft adapter, affixing a tightening screw to the engagement device, inserting the second end of the shaft adapter into a tubular grip support, the grip support having an interior surface comprising a plurality of notches and an exterior surface comprising a grip, sliding the grip support over the shaft adapter until the shaft and the grip support have a desired overall length, and tightening the screw with a tool to secure the grip support to the shaft adapter and prevent further sliding.

Yet another aspect of the present invention is a variable length golf club shaft comprising a shaft, a shaft adapter, an engagement device, a screw, and a cylindrical grip support, wherein the shaft adapter comprises a first end affixed to the shaft, a second end, and an exterior surface comprising a plurality of notches, wherein the engagement device is affixed to the grip support with the screw, wherein the shaft adapter is engaged with the grip support such that the engagement device fits within one or more of the plurality of notches, and wherein tightening the screw causes the engagement device to semi-permanently engage at least one of the plurality of notches.

Having briefly described the present invention, the above and further objects, features and advantages thereof will be recognized by those skilled in the pertinent art from the following detailed description of the invention when taken in conjunction with the accompanying drawings.

BRIEF DESCRIPTION OF THE SEVERAL VIEWS OF THE DRAWINGS

FIG. 9 is a side, cross-sectional, perspective view of the assembled variable length shaft shown in FIG. 1 interfacing with a tool.

DETAILED DESCRIPTION OF THE INVENTION

The present invention is directed to a variable length shaft that provides club length adjustability. Club length adjustability is an advantageous feature for golf clubs because, for example, extending the length of a club can have the desired effect of increasing club head speed, which results in longer driving distances. Conversely, shortening the length of a club would provide a golfer with more control and accuracy in driving the golf ball. Golf course conditions often require accurate driving due to hazards, including but not limited to water, rough, and out of bounds markers, and driving accuracy can be more preferred than driving distance in competitive situations.

The present invention is also valuable because a golfer's swing may change over time, thus requiring alterations to his or her clubs. A golfer may improve his or her game through lessons and may gain greater flexibility and strength through practice and exercise. As such, it is reasonable for a golfer to wish to change his or her club's length to help improve his or her accuracy, distance, and feel as needed or desired.

The present invention provides golfers with a system and method to easily, quickly and inexpensively modify the length of their golf clubs to have them perform in a desired manner. This invention will enable golfers to change their club length wherever they wish, including, but not limited to, at the practice range, the golf course, and their home. The present invention also is designed to avoid altering a club's swing weight or its "feel." The tool and components that are used to alter a club's length are small and can be carried in a pocket of the user's golf bag. Furthermore, the technical ability required to modify the golf club length according to this invention is minimal and its approach is intuitive and easy for a golfer to understand.

More specifically, the present invention is directed to a golf club having a gripping portion that can slide up and down a shaft portion and be fixed at predefined stops. The present adjustable shaft invention can be used with any golf club head, including driver, putter, and iron heads.

Figure 1:
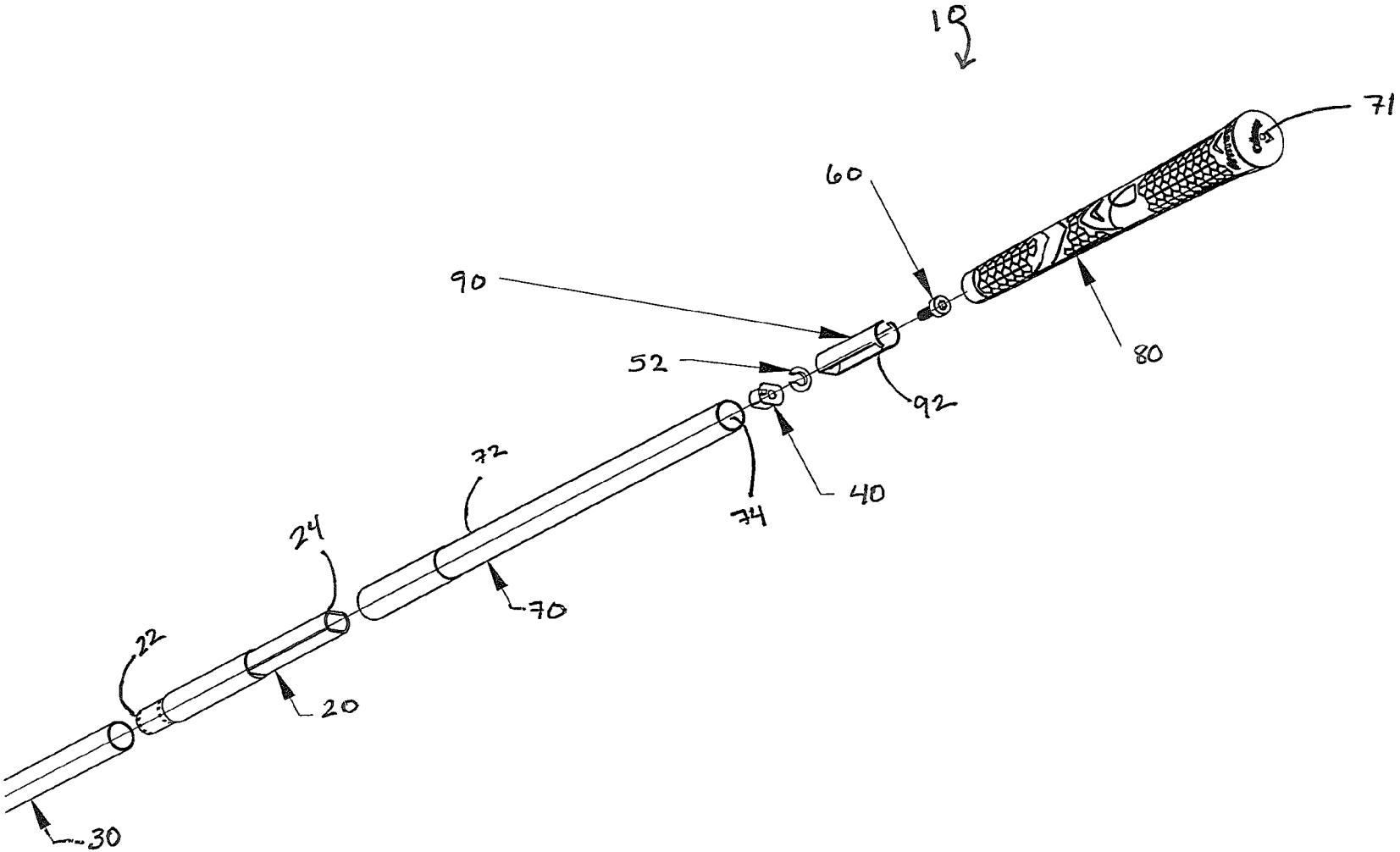
FIG. 1 is a side, plan view of an unassembled first embodiment of the variable length shaft of the present invention.

A preferred embodiment of the present variable length shaft system 10 is shown in FIGS. 1-5B. FIG. 1 shows a disassembled variable length shaft system 10 of the present invention, with each of the parts visible. The variable length shaft system 10 comprises a shaft adapter 20, which is bonded into a shaft 30 affixed to the desired golf club head 15 (shown in FIG. 11) at a first end 22, and an engagement adapter 40 bonded onto the shaft adapter 20 at the opposite, second end 24 of the shaft adapter 20. An engagement device 50, which in FIGS. 1-5B is a snap ring 52, is disposed proximate the engagement adapter 40 and is captured or affixed to the engagement adapter 40 by a screw 60.

Figure 3B:
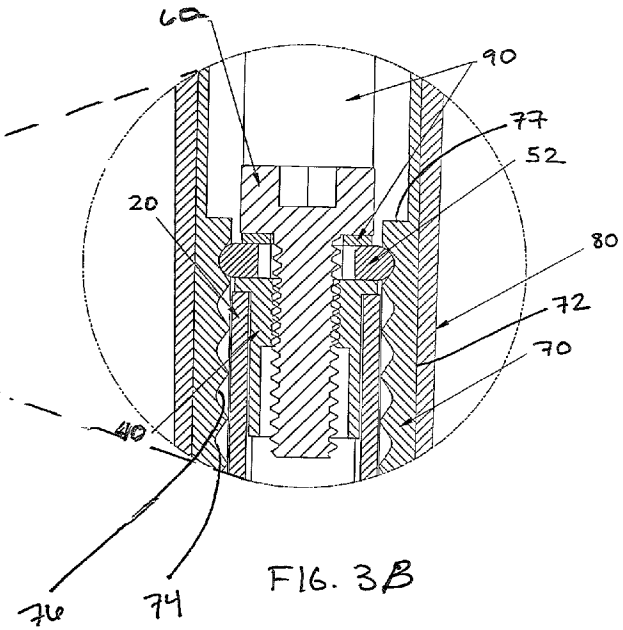
FIG. 3B is a magnified view of a section of the variable length shaft circled in FIG. 3A.
Figure 3A:
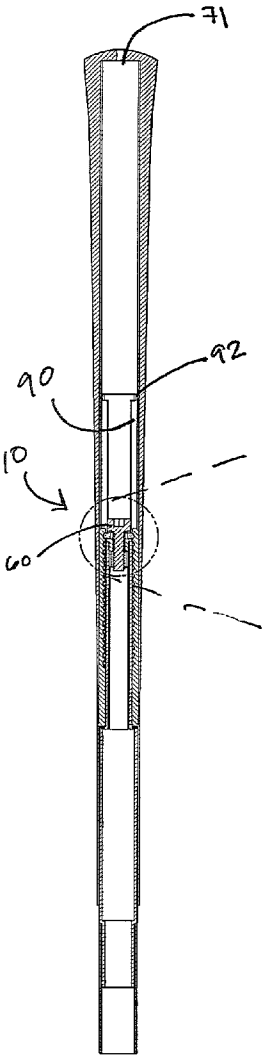
FIG. 3A is a side, cross-sectional view of the variable length shaft shown in FIG. 2 along lines A-A.
Figure 2:
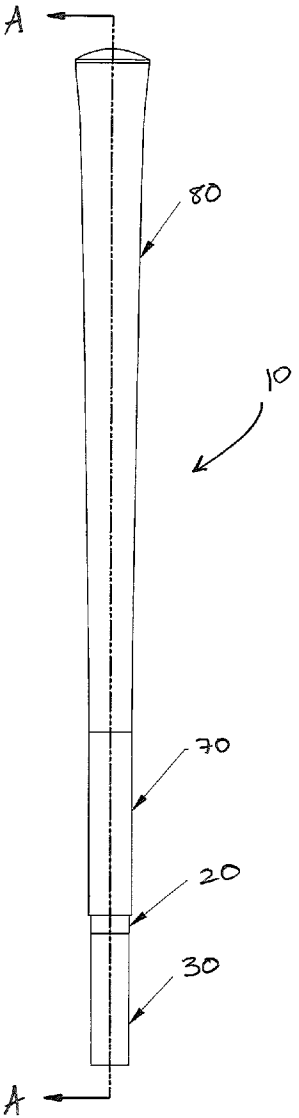
FIG. 2 is a side, plan view of an assembled first embodiment of the variable length shaft of the present invention.
Figures 4A, 4B:
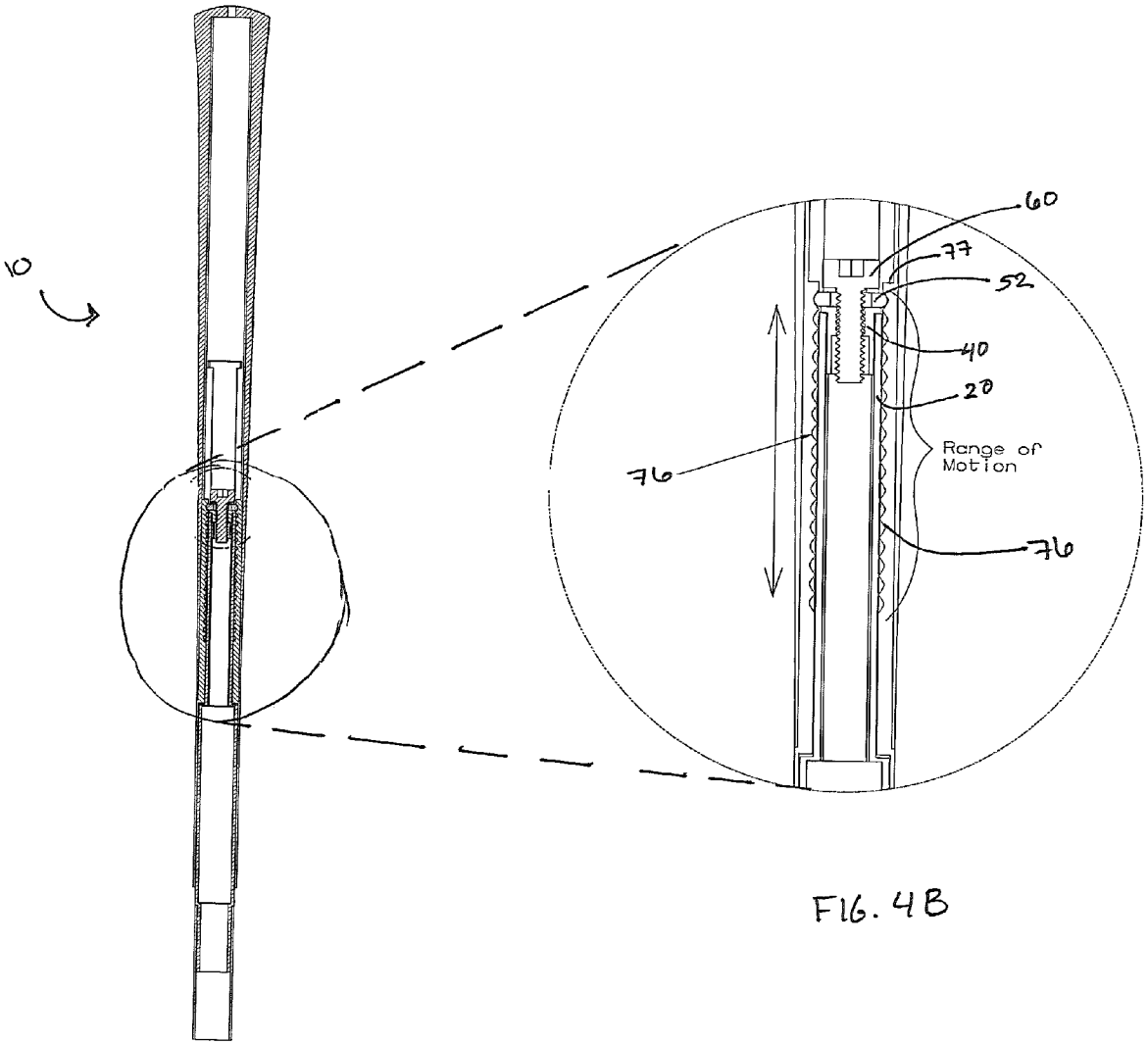
FIG. 4A is a side, cross-sectional view of the variable length shaft shown in FIG. 2 along lines A-A.
FIG. 4B is a magnified of view of a section of the variable length shaft circled in FIG. 4A.
Figure 5A:
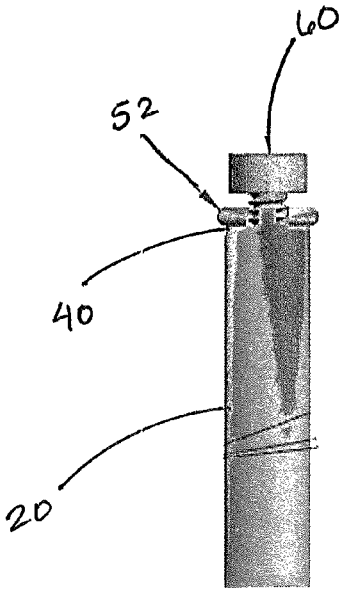
FIG. 5A is a side, plan view of the shaft adapter, snap ring, and tightening screw shown in FIG. 1 in assembled form.
Figure 5B:
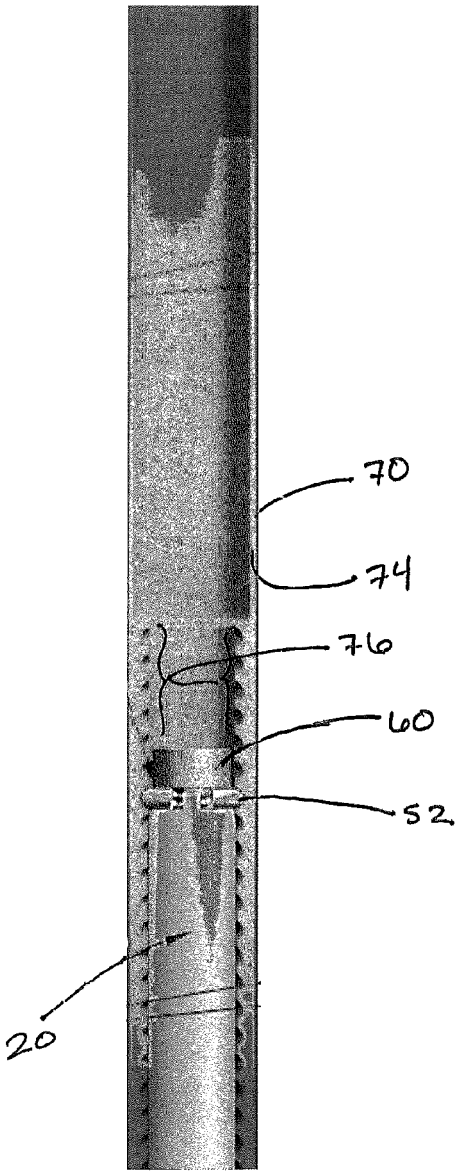
FIG. 5B is a side, cross-sectional view of the shaft adapter, snap ring, tightening screw, and grip support shown in FIG. 1 in assembled form.

Once the engagement device 50 is affixed to the engagement adapter 40 in a relaxed or released position, e.g., before the screw 60 is tightened against the engagement device 50, a hollow, tubular grip support 70 is connected to the shaft adapter 20 by sliding the grip support 70 over the shaft adapter 20, as shown in FIGS. 2 and 3A. The grip support 70 preferably is slid over the shaft adapter 20 such that at least a part of the shaft adapter 20, the entire engagement device 50, and the screw 60 are disposed within the hollow interior of the grip support 70, as shown in FIGS. 3A, 4A, and 4B. In an alternative embodiment, the grip support 70 may be connected to the shaft adapter 20 by splitting the grip support 70 lengthwise into two pieces and bonding them back together around the shaft adapter 20.

As shown in FIGS. 1, 3B, 4A, 4B, and 5B, the grip support 70 comprises an exterior surface 72 and an interior surface 74. A grip 80, which may be an off-the-shelf, industry standard grip or a custom-made grip, is affixed to the exterior surface 72 of the grip support 70 via an adhesive or a mechanical fastener. The interior surface 74 of the grip support 70 comprises a plurality of notches, divots, or grooves 76, which preferably extend around the circumference of the interior surface 74 of the grip support 70, as shown in FIGS. 3B, 4B, 5B, 6B, and 7B. The grip 70 support further comprises an opening at its upper-most surface 71 to permit a tool 100, shown in FIGS. 8 and 9, to access the interior of the grip support 70 and interface with the screw 60.

Figure 11:
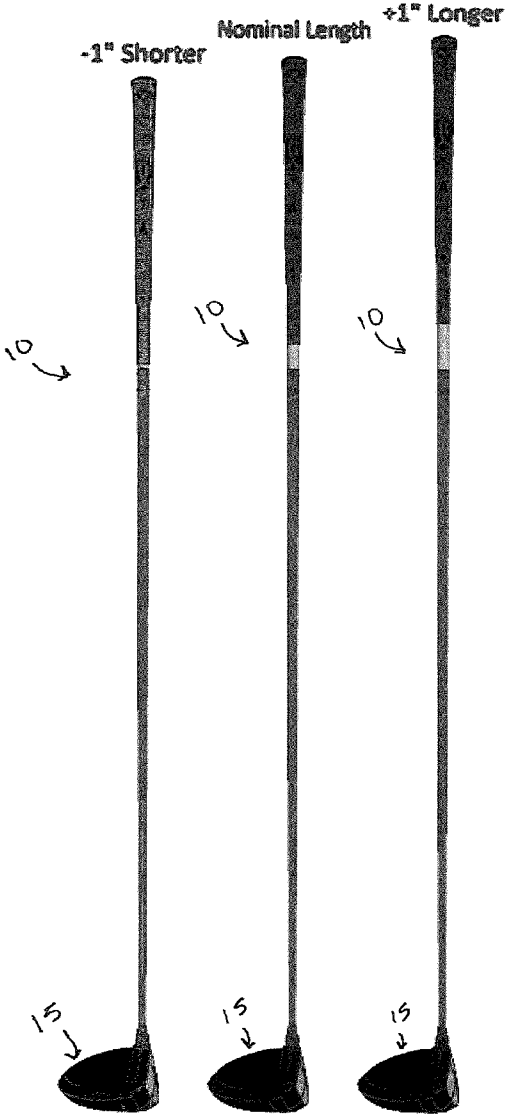
FIG. 11 is a side view of the variable length shaft shown in FIG. 1, assembled with a golf club head, having three different lengths.
Figure 10:
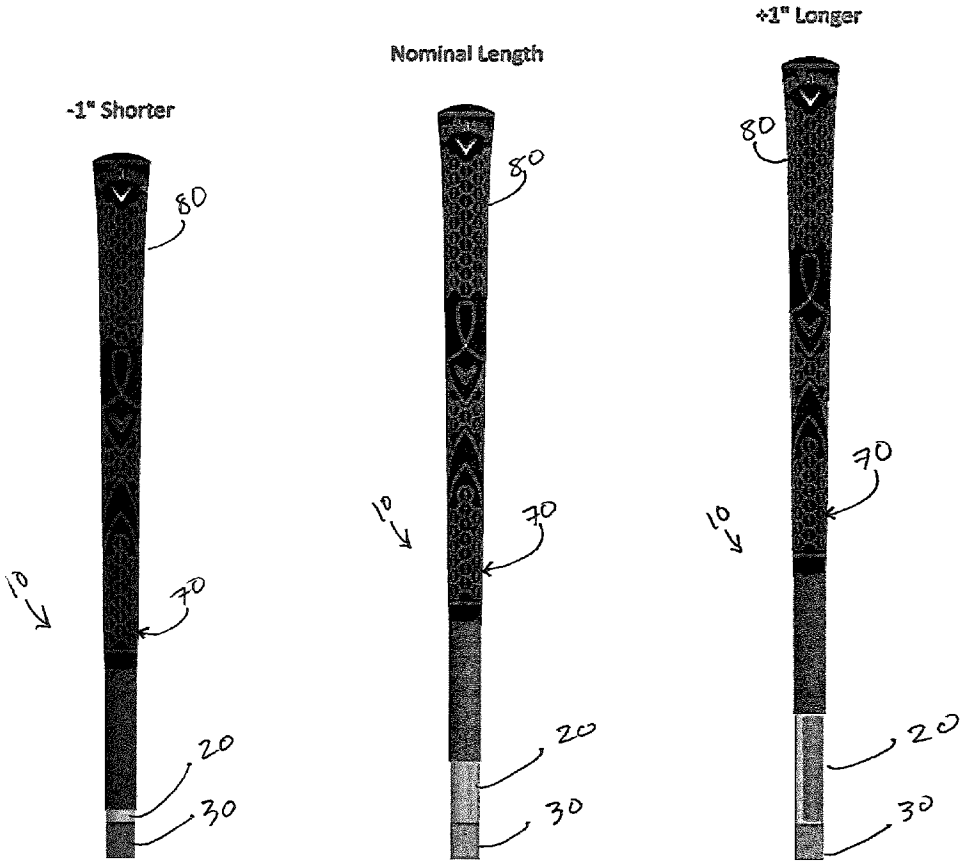
FIG. 10 is a side view of the assembled variable length shaft shown in FIG. 1 having three different lengths.

Each groove 76 is preferably spaced from each of its neighbors by at least 0.100 inch, and more preferably by approximately 0.125 inch. This spacing permits movement inside the grip support 70 and between each groove 76 within a predefined range. The complete range of movement provided by the grooves 76 can be as much as 6 inches or greater when used on a putter or driver shaft, while a range of 2 inches or greater may be more applicable for a shaft used on fairway woods, hybrids or iron heads. Preferably, the adjustment range is one to three inches, as shown in FIGS. 10 and 11, with incremental stops at every 0.125 inch for shafts used on any type of golfing head.

As the grip support 70 slides into place around the shaft adapter 20, the engagement device 50 is compressed between the sides of the grip support 70, and then expands into the grooves 76 on the interior surface 74 of the grip support 70. When the grip support 70, the shaft adapter 20, and the shaft 30 have an overall desired length, they are secured in place by tightening the screw 60 using a tool 100, as shown in FIGS. 8 and 9, such that the engagement device 50 is semi-permanently fixed in expanded form within at least one of the grooves 76. This configuration locks the grip support 70 onto the shaft adapter 20 and thus the rest of the club, providing a rigid connection so that the club can be used in a game of golf. The variable length shaft 10 of the present invention can be adjusted to have different lengths, preferably at least the three different lengths shown in FIGS. 10 and 11: nominal length; one inch longer than nominal length, and one inch shorter than nominal length, for a total range of two inches. In other embodiments, the shaft may be adjusted to have any number of potential lengths. In one embodiment, the variable length shaft 10 has a total length range of six inches.

In the preferred embodiment of the present invention, the engagement device 50 is a snap ring 52, as shown in FIGS. 1-5B and 9. When the snap ring 52 is in a relaxed position, it is slightly larger in diameter than the diameter of the notches 76 disposed on the interior surface 74 of the grip support 70, as shown in FIG. 5A. When the grip support 70 is slid over the snap ring 52, the snap ring 52 is compressed and its outer dimension is reduced, allowing the grip support 70 to slide past it. However, once the snap ring 52 contacts the grooves 76 on the interior surface 74 of the grip support 70, the snap ring 52 expands into the grooves 76. The snap ring 52 is preferably composed of a strong, lightweight material such as rubber, plastic, or composite, but may also be made of metal alloys or other materials.

As discussed above and as shown in FIGS. 5B and 8-9, when the assembly has a desired overall length, the screw 60 can be tightened, by means of a tool 100, to prevent the snap ring 52 from being compressed and disengaging with the groove 76, thus securing the grip support 70 to the shaft adapter 20 and therefore the rest of the golf club. The screw 60 can later be loosened and the grip support 70 can then be pushed or pulled axially along the shaft axis, compressing the snap ring 52 and allowing the grip support 70 to be repositioned on the shaft adapter 20, thereby changing the golf club's length. The screw will 60 then be tightened and the golf club will be ready for play at its new length. The pushing and pulling of the grip support 70 preferably is accompanied by audio feedback as the snap ring 52 expands or snaps into the grooves 76 as well as by tactile feedback as the snap ring 52 momentarily stops its sliding motion as it expands into an adjacent groove 76.

Figure 6A:
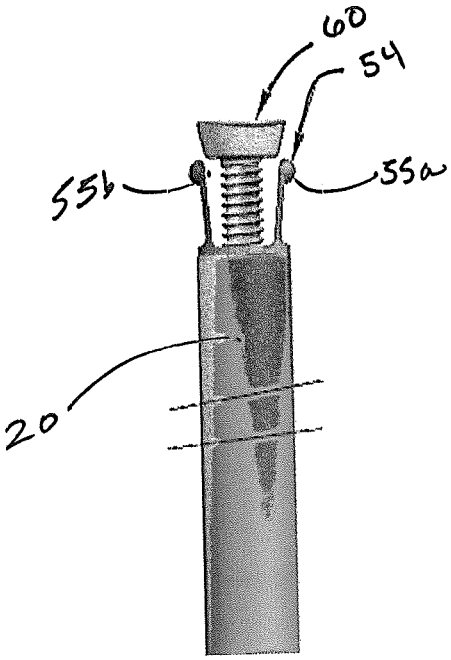
FIG. 6A is a side, plan view of a second embodiment of the present invention, including a shaft adapter, flange, and tightening screw in assembled form.
Figure 6B:
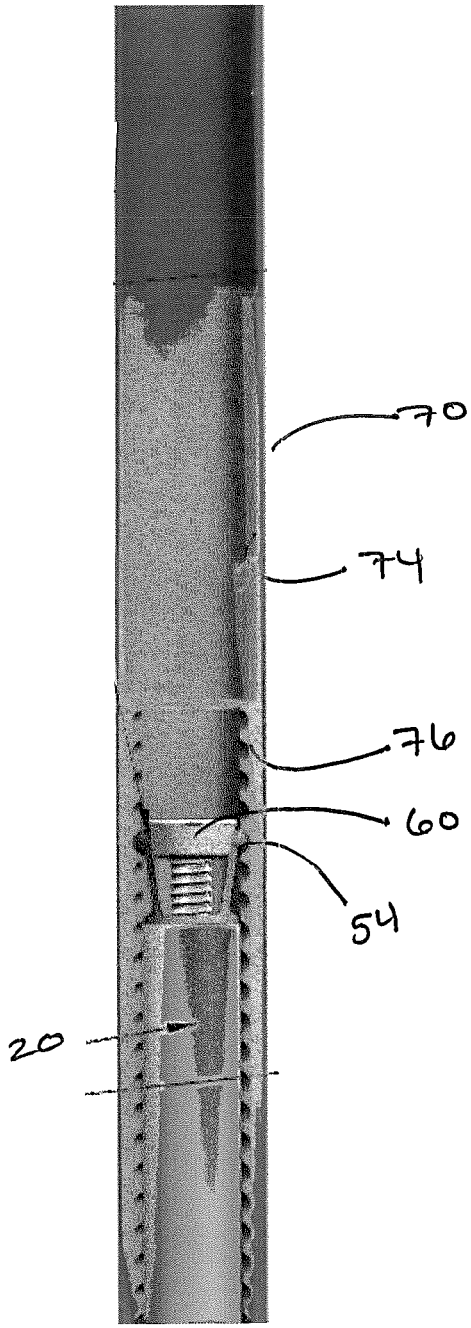
FIG. 6B is a side, cross-sectional view of a shaft adapter, flange, tightening screw, and grip support in assembled form.

In an alternative embodiment, the engagement device is a flange 54 component, shown in FIGS. 6A and 6B. The flange 54 operates in a similar fashion to the snap ring 52, but consolidates the functionality of the snap ring 52 and the engagement adapter 40 into a single component. The flange 54 has two or more protrusions or fingers 55*a*, 55*b* that are designed to fit snugly into the grooves 76 located on the interior surface 74 of the grip support 70. The screw 60, when tightened, is drawn between the two fingers 55*a*, 55*b*, expanding them and forcing them into the grooves 76. This prevents the fingers 55*a*, 55*b* from moving towards each other and allowing the grip support 70 to slide axially along the shaft adapter 20. The flange 54 is preferably composed of a strong, lightweight material such as rubber, plastic, or composite, but may also be made of metal alloys or other materials.

When the screw 60 is loosened, it moves away from the two fingers 55*a*, 55*b* of the flange 54. In this configuration, when the grip support 70 is pushed or pulled along the shaft adapter 20, the fingers 55*a*, 55*b* can be compressed towards each another, allowing the grip support 70 to be repositioned along the shaft adapter 20 so that a golfer can achieve a different overall shaft length. The pushing and pulling of the grip support preferably is accompanied by audio feedback as the fingers 55*a*, 55*b* snap into the grooves 76 as well as by tactile feedback as the fingers 55*a*, 55*b* momentarily stop the sliding motion as they expand into an adjacent groove 76.

Figure 7A:
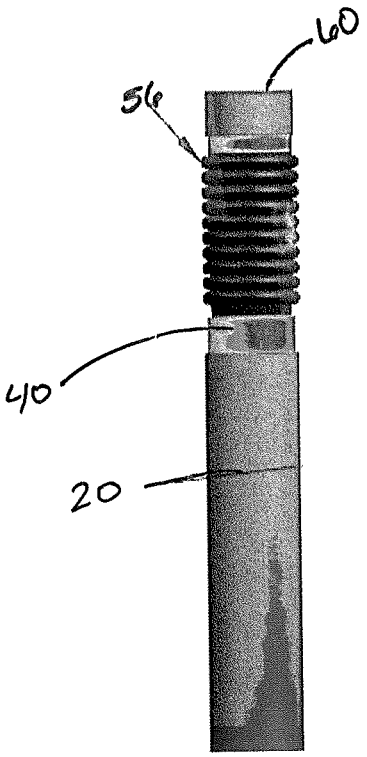
FIG. 7A is a side, plan view of a third embodiment of the present invention, including a shaft adapter, wedge, and tightening screw in assembled form.
Figure 7B:
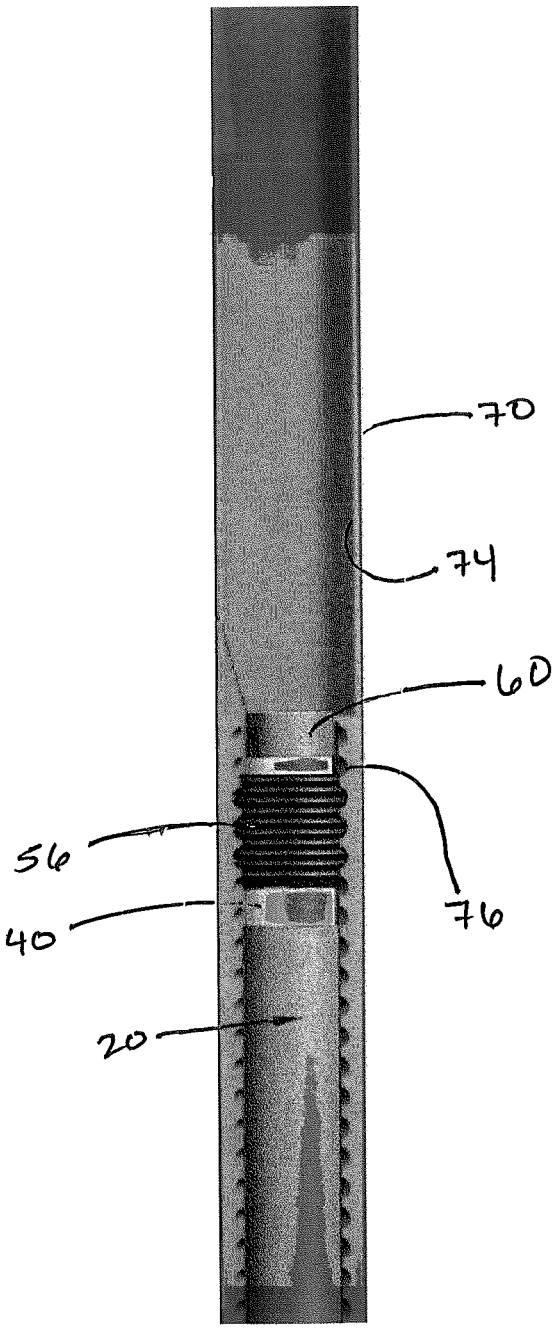
FIG. 7B is a side, cross-sectional view of a shaft adapter, wedge, tightening screw, and grip support in assembled form.
Figures 7, 8:
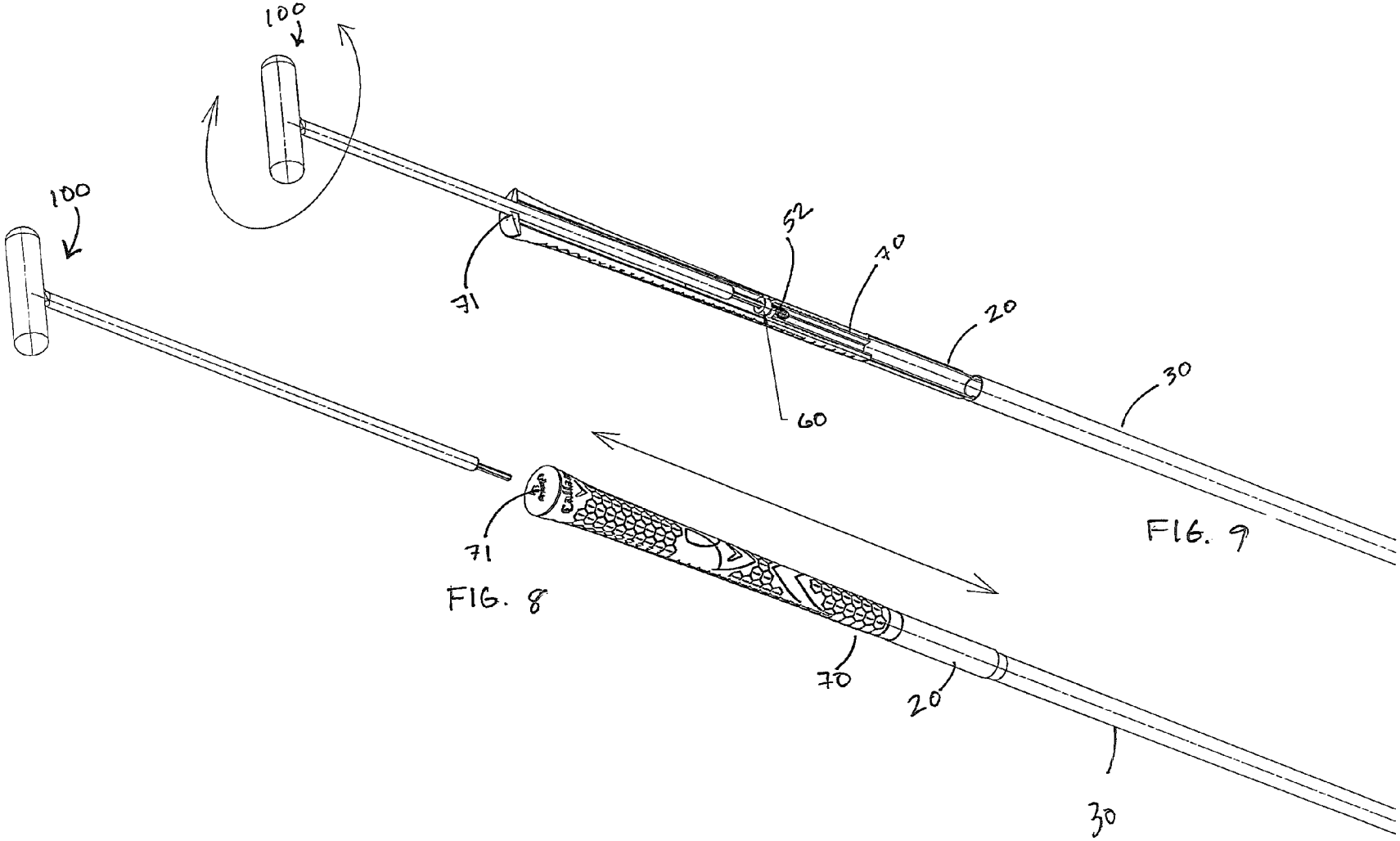
FIG. 8 is a side, perspective view of the assembled variable length shaft shown in FIG. 1 interfacing with a tool.

In yet another embodiment, shown in FIGS. 7A and 7B, the engagement device 50 is a wedge 56 component. The wedge 56 differs from the snap ring 52 and flange 54 because the wedge 56 is made from a softer material so that it can be physically compressed, axially as well as radially, into the grooves 76 disposed on the interior surface 74 of the grip support 70 as the tightening screw 60 is tightened. The wedge 56 preferably is made of a rubber or plastic material that flows into the grooves 76 and against the interior surface 74 of the grip support 70 and uses both mechanical locking and friction forces to restrict the relative movement of the grip support 70 on the shaft adapter 20 once the screw 60 is tightened. When the screw 60 is loosened, the wedge 56 is released from its compressed state and moves away from the interior surface 74 of the grip support 70, allowing movement of the grip support 70 along the shaft adapter 20 to a new location, thus changing the overall shaft length.

The fit and tolerances between the grip support 70 and the shaft adapter 20 preferably are close and fairly small both to allow sliding and to restrict rotation. Rotation may also be restricted by including non-circular cross sections on some portions of one or more of the components. For example, as shown in FIG. 1, the second end 24 of the shaft adapter 20 may have one or more straight sides to resist rotation when it is inserted into the grip support 70.

In some embodiments, the variable length shaft of the present invention may further comprise a travel limiter 90, which preferably is composed of a strong, lightweight material such as rubber, plastic, or composite, but may also be made of metal alloys or other materials. This optional component, shown in FIGS. 1 and 3B, is disposed between the engagement device 50 and the screw 60, is preferably tubular and cylindrical in shape to fit within the grip support 70, and has a top portion with a perpendicular extension or a flange 92. When the variable length shaft 10 of the present invention is fully assembled, as shown in FIG. 3A, and the grip support 70 is slid along the length of the shaft adapter 20 to increase the overall length of the club, the flange 92 of the travel limiter 90 eventually abuts an end 77 of one of the notches 76 and prevents the shaft adapter 20 from falling out of or becoming detached from the grip support 70.

In other embodiments, the engagement device 50 may be any other type of compressible or movable structure that is capable of engaging the grooves 76 on the interior surface 74 of the grip support 70 when the screw 60 is tightened, and moving between the grooves 76 when the screw 60 is loosened.

In yet another alternative embodiment, the engagement device 50 is disposed on the grip support 70 and the plurality of notches 76 is disposed on the shaft adapter 20, effectively reversing the configuration of the present invention shown in the Figures and described above. In this embodiment, the grip support 70 may be insertable into the shaft adapter 20, or vice versa.

Each of the components disclosed herein are preferably composed of one or more strong, lightweight, materials, such as a metal alloy including aluminum, titanium, steel, and/or magnesium, plastic, or graphite composite. The components preferably have material compositions that permit the weighting of the club to fall within USGA guidelines.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim as my invention:

1. A variable length golf club shaft comprising:

a shaft;

a shaft adapter;

an engagement adapter;

an engagement device;

a screw; and a cylindrical grip support comprising an exterior surface and an interior surface, the interior surface comprising a plurality of notches;

wherein the shaft adapter comprises a first end affixed to the shaft and a second end affixed to the engagement adapter, wherein the engagement device is affixed to the engagement adapter with the screw, wherein the shaft adapter is inserted into the grip support such that the engagement device fits within one or more of the plurality of notches, and wherein tightening the screw causes the engagement device to semi-permanently engage at least one of the plurality of notches.

2. The variable length golf club shaft of claim 1, wherein the engagement device is a snap ring.

3. The variable length golf club shaft of claim 1, wherein the engagement device is a flange.

4. The variable length golf club shaft of claim 1, wherein the engagement device is a wedge.

5. The variable length golf club shaft of claim 1, wherein at least a portion of the exterior surface of the grip support comprises a grip.

6. The variable length golf club shaft of claim 1, wherein at least one of the plurality of notches extends around the circumference of the interior surface of the grip support.

7. The variable length golf club shaft of claim 1, wherein the grip support comprises an opening located at an uppermost end of the grip support sized to permit access to the screw when the variable length golf club shaft is fully assembled.

8. The variable length golf club shaft of claim 1, wherein the plurality of notches comprises at least two notches.

9. The variable length golf club shaft of claim 8, wherein the two notches are spaced from each other by a distance of between 0.100 and 1.00 inch.

10. The variable length golf club shaft of claim 9, wherein the distance is approximately 0.125 inch.

11. The variable length golf club shaft of claim 1, further comprising a travel limiter.

12. A golf club comprising: a golf club head; a shaft having a tip end and a butt end, the tip end connected to the golf club head; a shaft adapter comprising a first end affixed to the butt end of the shaft and a second end affixed to an engagement device; a cylindrical grip support disposed around the shaft adapter, the grip support comprising an interior surface comprising a plurality of notches and an exterior surface comprising a grip; and a screw, wherein the grip support has a diameter large enough to permit the grip support to slide along the length of the shaft adapter when the engagement device is not in a tightened configuration, and wherein tightening the screw causes the engagement device to semi-permanently engage one or more of the plurality of notches, and prevents the grip support from sliding along the 10 length of the shaft adapter.

13. The golf club of claim 12, wherein the engagement device is selected from the group consisting of a snap ring, a flange, and a wedge.

14. The golf club of claim 12, wherein the golf club head is a driver head.

15. The golf club of claim 12, further comprising a travel limiter.

16. The golf club of claim 12, wherein each of the plurality of notches is spaced from neighboring notches by at least 0.100 and no more than 0.150 inch.

17. The golf club of claim 16, wherein each of the plurality of notches is spaced from neighboring notches by approximately 0.125 inch.

18. The golf club of claim 12, wherein the second end of the shaft adapter has a non-circular cross-section.

19. The golf club of claim 12, wherein the grip support has a total range of movement of five inches.

* * * * *

UNITED STATES PATENT AND TRADEMARK OFFICE

CERTIFICATE OF CORRECTION

PATENT NO. : 8,485,915 B2
APPLICATION NO. : 13/286791
DATED : July 16, 2013
INVENTOR(S) : D. Clayton Evans It is certified that error appears in the above-identified patent and that said Letters Patent is hereby corrected as shown below:

On the Title Page

Item (73) Assignee should read: Callaway Golf Company, Carlsbad, CA (US)

Signed and Sealed this
Third Day of September, 2013

Teresa Stanek Rea
*Acting Director of the United States Patent and Trademark Office*